US009433847B2

(12) United States Patent
Roberts

(10) Patent No.: US 9,433,847 B2
(45) Date of Patent: Sep. 6, 2016

(54) GOLF CLUB GRIP EXTENSION AND CHIPPING TRAINING AID

(71) Applicant: Ronald Roberts, Somerset, KY (US)

(72) Inventor: Ronald Roberts, Somerset, KY (US)

( * ) Notice: Subject to any disclaimer, the term of this patent is extended or adjusted under 35 U.S.C. 154(b) by 128 days.

(21) Appl. No.: 14/042,826

(22) Filed: Oct. 1, 2013

(65) Prior Publication Data

US 2014/0094323 A1 Apr. 3, 2014

Related U.S. Application Data

(60) Provisional application No. 61/708,747, filed on Oct. 2, 2012.

(51) Int. Cl.

| | |
|---|---|
| ***A63B 53/16*** | (2006.01) |
| ***A63B 69/36*** | (2006.01) |
| ***A63B 69/00*** | (2006.01) |
| ***A63B 53/14*** | (2015.01) |

(52) U.S. Cl.

CPC ..... *A63B 69/3632* (2013.01); *A63B 53/14* (2013.01); *A63B 60/14* (2015.10); *A63B 60/16* (2015.10); *A63B 60/22* (2015.10); *A63B 60/28* (2015.10); *A63B 69/0057* (2013.01); *A63B 53/16* (2013.01); *A63B 69/36* (2013.01); *A63B 2210/50* (2013.01)

(58) Field of Classification Search

CPC ..... A63B 53/02; A63B 53/16; A63B 59/06; A63B 69/36; A63B 60/28

USPC ..... 473/564, 579, 307, 318, 299, 296, 288, 473/219, 300, 316, 409, 297, 227, 313, 314, 473/341, 256

See application file for complete search history.

(56) References Cited

U.S. PATENT DOCUMENTS

| | | | | | |
|---|---|---|---|---|---|
| 1,586,469 | A | * | 5/1926 | Revell | 473/299 |
| 1,613,360 | A | * | 1/1927 | Rigby | 473/296 |
| 1,994,149 | A | * | 3/1935 | Root | A63B 53/02 473/305 |
| 2,217,360 | A | * | 10/1940 | Court | 15/4 |
| 2,294,719 | A | * | 9/1942 | Court | 239/244 |
| 2,538,348 | A | * | 1/1951 | Amphlett | 473/579 |
| 2,674,470 | A | * | 4/1954 | Appleton | 285/154.1 |
| 2,750,222 | A | * | 6/1956 | Borah | 294/19.2 |
| 2,787,196 | A | * | 4/1957 | Stadler | 408/83.5 |
| 2,819,108 | A | * | 1/1958 | Borah | 294/19.2 |
| 2,827,263 | A | * | 3/1958 | Scott et al. | 175/93 |
| 2,869,412 | A | * | 1/1959 | Mathias | 82/169 |
| 2,906,550 | A | * | 9/1959 | Miller | 74/548 |
| 3,083,969 | A | | 4/1963 | Bills | |
| 3,524,646 | A | * | 8/1970 | Wheeler | 473/288 |
| 4,245,544 | A | * | 1/1981 | Holland | 84/465 |
| 4,595,204 | A | * | 6/1986 | Patterson | 473/227 |
| 4,831,702 | A | * | 5/1989 | Vossbrinck et al. | 29/890.031 |
| 4,967,468 | A | * | 11/1990 | Vossbrinck et al. | 29/726 |
| 5,188,402 | A | * | 2/1993 | Colgate et al. | 285/332 |
| 5,209,474 | A | | 5/1993 | Voyer | |

(Continued)

*Primary Examiner* — Benjamin Layno

(74) *Attorney, Agent, or Firm* — Michael Coblenz

(57) ABSTRACT

A golf club grip extension and chipping training aid comprising a tubular grip extension having a central bore sized to accommodate the grip and shaft of a standard golf club such that the golf club can be inserted into the grip extension and secured. The grip extension can be removably attached with a slotted and threaded grommet that fits over the club shaft and screws into threading at the bottom of the grip extension. The club with the grip extension is a chipping training aid that allows a golfer to practice a chip shot with the grip extension pressed against the body to teach the chip shot without movement of the wrists.

6 Claims, 7 Drawing Sheets

(56) References Cited

U.S. PATENT DOCUMENTS

| | | | | | |
|---|---|---|---|---|---|
| 5,280,966 | A | * | 1/1994 | Morris et al. | 285/89 |
| 5,520,392 | A | | 5/1996 | Foresi et al. | |
| 5,524,902 | A | * | 6/1996 | Cornette | 277/308 |
| 5,544,879 | A | * | 8/1996 | Collins | 473/314 |
| 5,674,134 | A | * | 10/1997 | Blankenship | A63B 53/10 473/296 |
| 5,718,090 | A | * | 2/1998 | Wei-Hwang | 52/223.14 |
| 5,785,608 | A | * | 7/1998 | Collins | 473/313 |
| 5,785,850 | A | * | 7/1998 | Lynch et al. | 210/304 |
| 5,794,295 | A | * | 8/1998 | Shen | 15/22.1 |
| 5,830,082 | A | | 11/1998 | White | |
| 5,855,524 | A | | 1/1999 | Jenkins | |
| 5,860,242 | A | * | 1/1999 | O'Neil | 42/97 |
| 5,924,937 | A | * | 7/1999 | Kuo | 473/296 |
| 5,944,699 | A | * | 8/1999 | Barrelle et al. | 604/240 |
| 5,976,030 | A | * | 11/1999 | Hsieh | 473/296 |
| 5,997,408 | A | | 12/1999 | Bankhead | |
| 6,068,562 | A | | 5/2000 | Hedges | |
| 6,180,882 | B1 | * | 1/2001 | Dinh | 174/655 |
| 6,283,874 | B1 | * | 9/2001 | Studebaker | 473/227 |
| 6,637,980 | B2 | * | 10/2003 | Robertson, Jr. | 405/259.1 |
| 7,112,150 | B2 | | 9/2006 | Dionne | |
| 7,159,864 | B1 | * | 1/2007 | Fleury | 273/108.2 |
| 7,789,765 | B2 | | 9/2010 | Marini | |
| 2002/0082102 | A1 | * | 6/2002 | Reilly | 473/219 |
| 2002/0091010 | A1 | * | 7/2002 | Tanimoto | 473/256 |
| 2002/0198061 | A1 | | 12/2002 | Mitchell | |
| 2003/0050132 | A1 | * | 3/2003 | Wilbur | 473/296 |
| 2004/0198528 | A1 | | 10/2004 | Balcer | |
| 2005/0220534 | A1 | * | 10/2005 | Ober | 403/370 |
| 2006/0252570 | A1 | | 11/2006 | Merriman | |
| 2006/0252586 | A1 | * | 11/2006 | Nguyen | 473/564 |
| 2007/0184729 | A1 | * | 8/2007 | Kicker | 440/102 |
| 2007/0191156 | A1 | * | 8/2007 | Van Nguyen | 473/564 |
| 2007/0275790 | A1 | * | 11/2007 | Droppleman | 473/307 |
| 2010/0105498 | A1 | * | 4/2010 | Johnson | 473/318 |
| 2010/0159419 | A1 | * | 6/2010 | Grant | 433/174 |
| 2011/0081984 | A1 | * | 4/2011 | Beach et al. | 473/296 |
| 2012/0223522 | A1 | * | 9/2012 | Graham | 285/385 |

* cited by examiner

GOLF CLUB GRIP EXTENSION AND CHIPPING TRAINING AID

CROSS REFERENCE TO RELATED APPLICATIONS

This application claims priority to U.S. provisional application Ser. No. 61/708,747, filed on Oct. 2, 2012, and incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a golf chipping training aid, and more specifically to a grip extension that can be added on to a standard golf club, and where the grip extension can be held between the body and the arm to stabilize the wrists during chipping.

2. Description of the Related Art

Chipping a golf ball is one of the more difficult golf skills to master. Typically a chip shot is a short shot that is commonly played from very close to and around the green, and that is intended to strike the ball so that it travels through the air over a very short distance and rolls the remainder of the way to the hole. Because of the need to control the distance that the ball travels, the swing is different from a conventional golf swing, but not quite the same as the swing for a putt. One of the common problems golfers encounter when chipping is the excess use of the wrists, which can cause poor contact with the ball.

A number of different clubs are commonly used to chip the ball. Perhaps the most common is the pitching wedge, but some golfers also use a sand iron or sand wedge. The use of these clubs can cause some confusion because a pitch is generally a much longer shot than a chip. Wedges are shorter clubs with higher lofts, but some golfers use clubs with lower lofts, such as a 6 or 7 iron for chipping. There are also a number of specialty chipping clubs. A chip shot requires much more finesse than a longer shot because the ball need only go a relatively short distance, and because the golfer wants to precisely control the distance to be able to place the ball as near the hole as possible. Because of the need to control the distance that the ball needs to be hit, it is important that the golfer hit the ball relatively softly. In this the chip is somewhat similar to the putt, where the distance the ball is hit is a product of the speed of the swing. The most common way to do this is through shoulder and arm movement, and not wrist movement.

Limiting the use of the wrist in chipping is difficult because wrist rotation is an integral part of the standard full golf swing. Wrist rotation helps increase the club head speed and increases the distance that the ball can be struck. In some shorter shots wrist motion can increase the spin placed on the ball. However on shorter shots, like a chip, excess wrist movement or wrist rotation can result in a mishit of the ball. If too much wrist is used in a chip and the swing is not executed perfectly, the club head can hit behind the ball, causing a very poor shot because the ground will take momentum off the club head, or hit the ball too high, resulting in a low shot with more speed than the golfer intended, or can slice under the ball, resulting in a pop-up shot with very little distance. In order to avoid this golfers try to use as little wrist motion as possible in a chip.

There are a number of techniques used to try to limit wrist movement during chipping. One common technique is to stand with an open stance, with the body facing slightly toward the target line, and swing the club to the side. This can only be accomplished with limited wrist movement. Another common technique is to have a severe forward press, with the hands ahead of the club head and the club head angled down toward the ground. Both limit wrist movement, but both are difficult to explain and teach. There is a need, therefore, for a training aid that allows a golf instructor to show and explain to a student how to swing the club during a chip shot with little or no wrist rotation or movement.

There are a number of golf training aids that include an elongated section protruding from the club to aid the golfer in alignment or to teach the proper swing path. These include U.S. Pat. No. 5,520,392, to Foresi et al., which discloses an elongated member that is clamped to the side of the club shaft, and which extends upward. The golfer can slide the extended member under the arm pit to stabilize certain aspects of the swing. U.S. Pat. No. 5,997,408 to Bankhead is drawn to a an elongated shaft that is attached to the club shaft by means of a housing. The elongated shaft extends upward roughly parallel to the club shaft and allows the golfer to place under the arm and to align the grip in relation to the body. U.S. Pat. No. 7,789,765 to Marini discloses a telescoping rod that is mounted to the top end of the golf grip, and provides an alignment tool to allow the golfer to check his practice swing. These training aids can be used to instruct proper swing elements, but are not designed for striking the ball. It is often important to actually strike the ball to learn the proper swing technique. There is a need, therefore, for a training aid that is attached in a way to allow the golfer to strike the ball while using the training aid.

There are a number of golf clubs with extended grips, but most are putters. Examples include U.S. Pat. No. 5,209,474 to Voyer, which discloses a putter with an elongated shaft. The shaft is a single piece of metal, typically stainless steel. U.S. Pat. No. 5,544,879 to Collins. The invention is drawn to the putter club head, but the invention discloses a long shaft with two separate grip areas. There are also a few long shaft clubs that are not putters. Examples include U.S. Pat. No. 5,830,082, which is drawn to a long shaft chipping club, but the main inventive feature is the configuration of the club head. U.S. Pat. No. 5,885,524 to Jenkins is also drawn to a long shaft cupping club, with the main inventive feature the configuration of the club head. U.S. Pat. No. 6,342,018 to Mason is drawn to a club with a slightly longer than normal shaft, with the main inventive feature being a unique club head design. U.S. Pat. No. 6,068,562 to Hedges, which is drawn to a club with a long shaft, but more particularly to a method of hitting a golf ball with a club having a long shaft. U.S. Pat. No. 7,112,150 to Dionne is drawn to a method of chipping using a long golf club and a club with a head at an high angle. All of the clubs that are specifically designed for actually striking the ball use an elongated club shaft that is a single piece of club shaft material which is simply longer than a standard club. None discloses an add on for a standard club that is attached with sufficient security to be used during practice to strike the ball, and that can then be removed so that the player can use the club during play. There is a need, therefore, for a club extension that can be added on to a conventional club for practice and training of proper golf technique.

SUMMARY OF THE INVENTION

The invention consists of a grip extension added to the end of a standard club which extends the grip. The player holds the grip extension between the arm and body to prevent the wrists from moving, twisting, or cocking during the chip shot. The grip extension consists of a tube with a central bore that is slightly larger than the top of the standard grip, and that slides onto the standard club grip, and is, therefore, coaxial with the club shaft. There is an attachment that allows the grip extension club to be securely attached to the shaft of the club so that the club does not move within the grip extension. In one embodiment the attachment is a removable grommet that allows the club to be securely, but removably, attached into the grip extension, and in another embodiment the attachment permanently attaches the grip extension to the club.

The grip extension is attached over the standard golf grip and provides a chipping training aid. The grip extension is held near the bottom where the grip extension covers the standard golf grip. It is held as if it were the standard golf grip. The golfer addresses the ball as if to make a standard chip shot. The grip extension is held against the side of the body, and the club is swung with the grip extension held against the side of the body. This keeps the wrists from bending or breaking. It allows the golfer to take a practice swing, and hit practice chip shots while developing the proper feel for a proper chip shot. Using the grip extension the golfer will develop the proper stance for a consistent chip shot. The golfer will develop the proper hand position, which is with the hands in front of the ball, for a proper chip shot. Because the golfer can also hit practice chip shots with the grip extension attached to the club, the golfer will develop the proper feel when swinging the club for the chip shot, and will learn to hit consistent chip shots without moving or breaking the wrist during the chip shot.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 1:
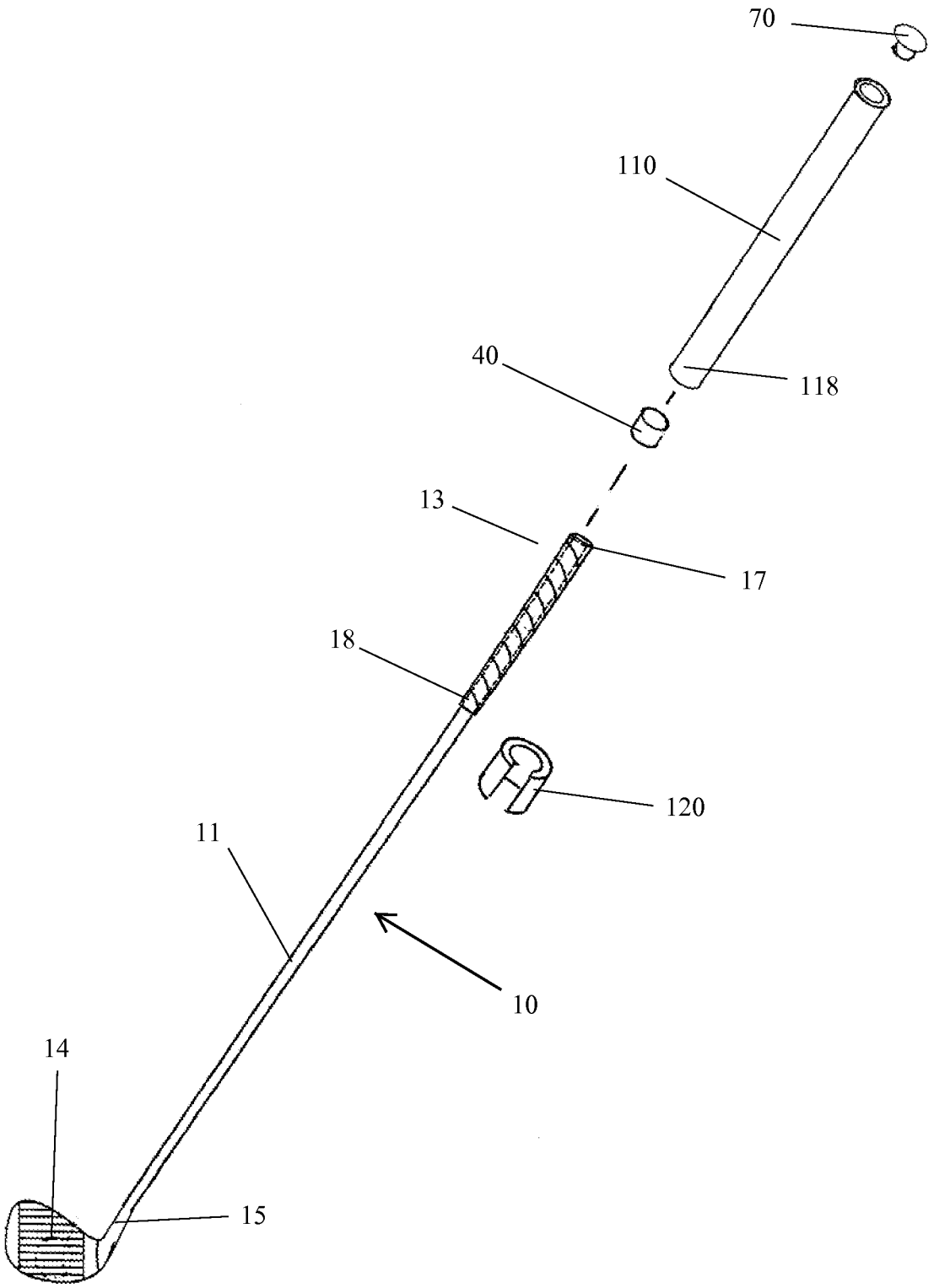
FIG. 1 is an exploded perspective view showing the components of the invention.

The standard club 10, as seen in FIG. 1, consists of a shaft 11, which is typically a tapered stainless steel tube, a grip 12, which is typically a rubberized covering over the top end 13 of the shaft 11, a club head 14 which is attached to the bottom end 15 of the shaft 11. Golf clubs are well known in the art, and are described here for reference, and form no part of the present invention. Standard grips 12 are tapered from narrow at the bottom of the grip, or grip bottom 18, which is where the shaft 11 enters the grip, to wider at the top of the grip, or grip top 17, which roughly corresponds to the top end 13 of the shaft. This taper in the grip aids in gripping the club, since the centrifugal force pulls the club away from the player, the tapered grip is forced into the hands, thus securing the club into the hands. Grips 12 are typically made of rubber, or a rubbery synthetic material that is slightly tacky to aid in the golfer's grip, and slightly plastic or flexible so that there is a slight amount of give in the grip 12.

The invention consists of an grip extension 110, which is an elongated hollow tube. There is an end cap 70 attached one end of the grip extension 110, a cupped plug 40 inserted into the grip extension 110, and a tapered slotted grommet 120 that slides onto the shaft 11 of the golf club 10 and that attaches the golf club 10 to the grip extension 110.

Figure 2:
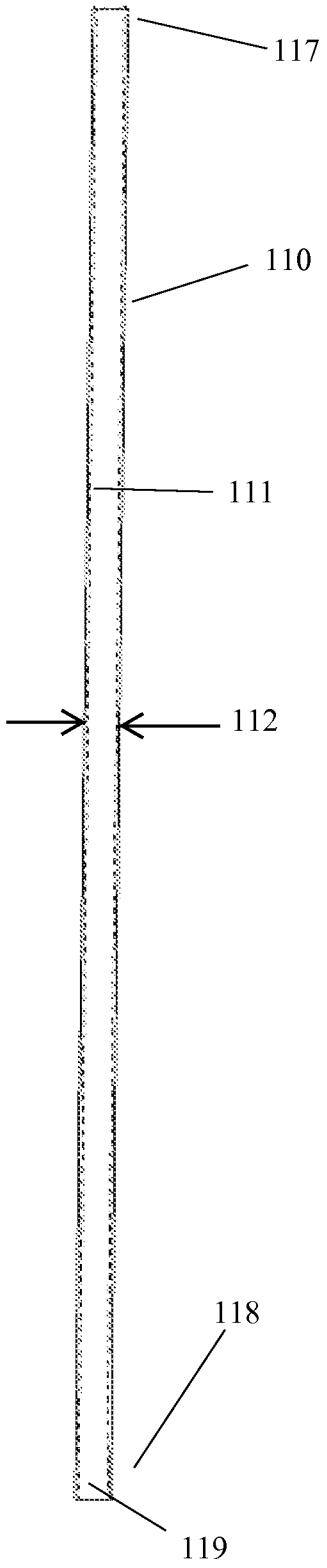
FIG. 2 is a plan view of the grip extension.

The grip extension 110 is an elongated hollow tube with a central bore 111 having an inner diameter 112, as seen in FIG. 2. In the preferred embodiment the grip extension is an aluminum tube that is 34 inches long, with a 1¾ inch outer diameter and 1⅛ inch inner diameter 112. The length and specifications of the tube can vary slightly to accommodate different sized clubs and golfers. Other light metals or other suitable materials may also be used for the grip extension. The grip extension 110 runs from a top 117 to a bottom 118. There are internal threads 119 at the bottom 118 of the central bore 111 of the grip extension 110. In the preferred embodiment the internal threads 119 are 1¾ inches deep running up into the central bore 111. The threads are 1 3/16-16 threads.

Figure 3:
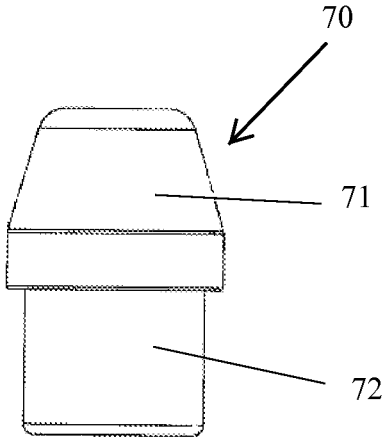
FIG. 3 is a plan view of the end cap.
Figure 4:
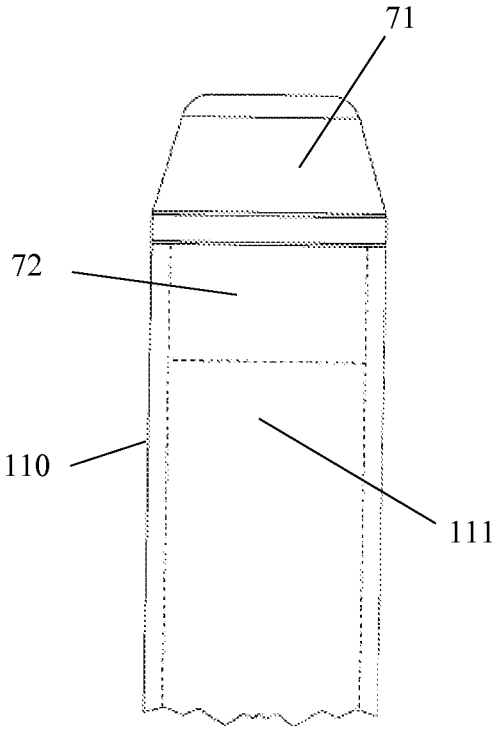
FIG. 4 is a plan view of the end cap inserted into the end of the grip extension.

The inner bore 111 runs the entire length of the extended grip 110, so there is an open end on both sides. There is an end cap 70, shown in FIG. 3, that is inserted at the top end 117 of the grip extension 110. The end cap 70 consists of a cap top 71, and a cap plug 72. The cap plug 72 is sized to fit into the central bore 111 to close the inner bore 111 at the top end 117 of the grip extension 110. This prevents the introduction of foreign materials or objects into the inner bore 111 of the extended grip 110. The end cap 70 is shown inserted into the top end 117 of the grip extension 110 in FIG. 4. In the preferred embodiment the cap plug 72 has a 1⅛ outer diameter, which is sized to fit snuggly into the inner diameter 112 of the central bore 111. In the preferred embodiment the end cap is made from cellulous acetate, but can be made of any suitable plastic or any other suitable material. In the preferred embodiment the end cap 70 is press fit into the inner bore 111, but in alternate embodiments can be secured into the inner bore 111 by means of glue.

Figure 5:
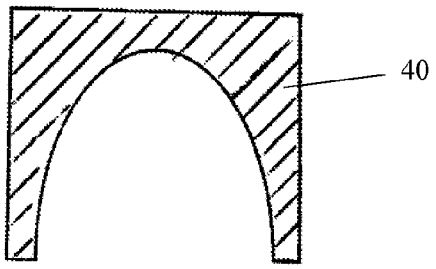
FIG. 5 is a plan view of the cupped plug.
Figure 6:
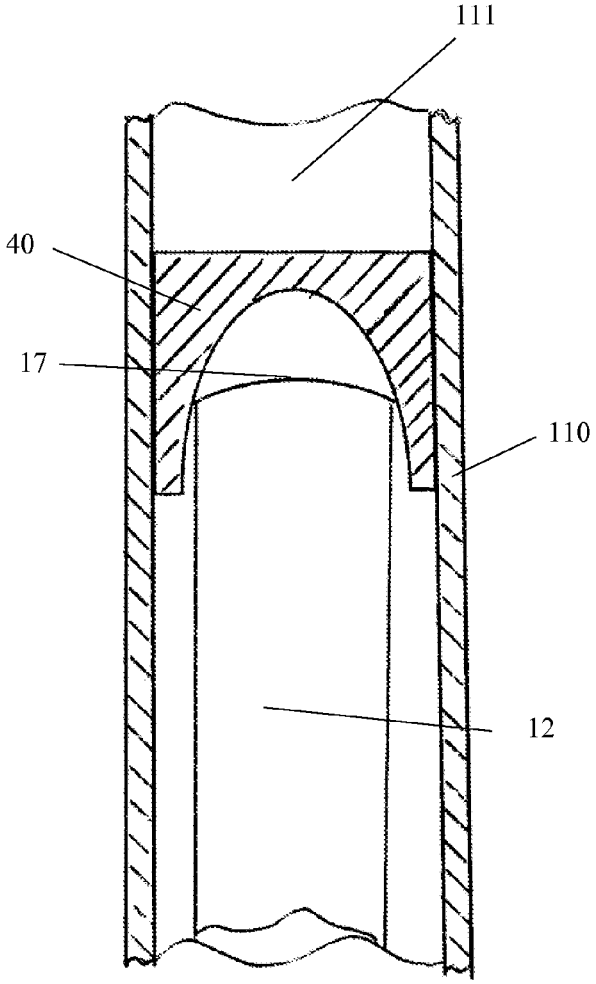
FIG. 6 is a cut away plan view of the grip end in the cupped plug and the cupped plug in the inner bore of the grip extension.

There is a cupped plug 40 which is inserted into the inner bore 111 to prevent the golf club 10 from sliding too far into the grip extension 110. The cupped plug 40, as seen in the cross section view of FIG. 5, has a curved cross section with beveled walls to accommodate grips 12 of varying sizes. The cupped plug 40 has a diameter of slightly smaller than the inner diameter 112 such that the capped plug 40 can be fit into the inner bore 111, and secured by gluing or other suitable methods. The cupped plug 40 can be made of aluminum or plastic, or any other suitable material. The curved cupped inside of the cupped plug 40 allows the cupped plug 40 to secure clubs 10 with varying grip sizes within the grip extension 110. The curved cross section of the inside of the cupped plug 40 allows the grip end 17 to be pushed into the cupped plug 40 to prevent movement of the grip 12 inside the inner bore 111.

Figure 7:
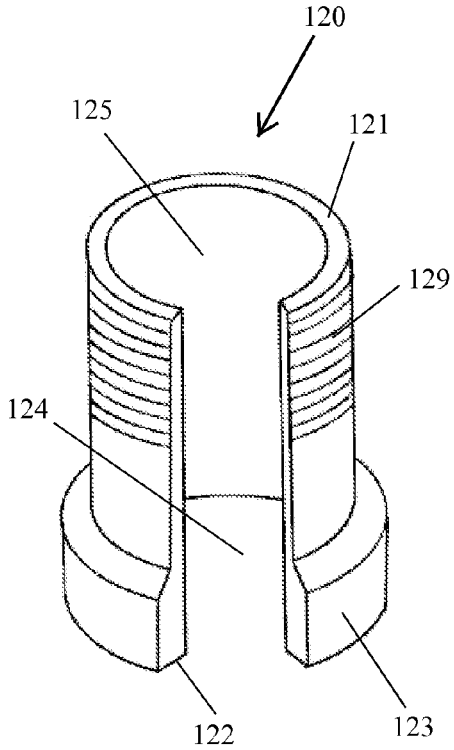
FIG. 7 is a perspective view showing the elements of the grommet.
Figure 8:
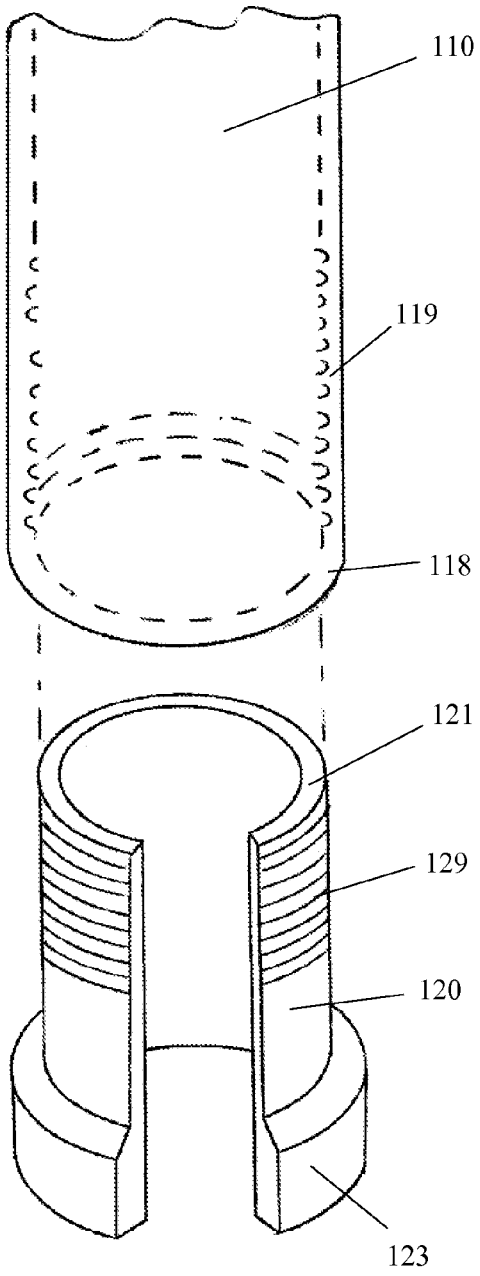
FIG. 8 is an exploded perspective view of the grommet and the threaded end of the grip extension.

The second main component of the invention is a tapered slotted grommet 120, shown in FIG. 7. The slotted grommet 120 is a cylindrical tube with a central shaft opening 125, which is tubular, tapered, and sized to engage the shaft 11 of the club 10. The slotted grommet 120 has a slot 124 that runs the length of the grommet 120 from the grommet bottom 122 to the grommet top 121. The slot 124 is sized to allow the shaft 11 to slide into the central shaft opening 125. The slotted grommet 120 has a collar 123, which has a diameter that is larger than the diameter of the rest of the slotted grommet 120 to prevent the slotted grommet 120 from going to far into the grip extension 110 as described below. The slotted grommet 120 also has external threads 129. The slotted grommet 120 is made from a resin plastic. In the preferred embodiment it is made from acetal delrin, or polyoxymethulene, which is sold under the DuPont brand as Delrin. It is possible for the grommet to be made of any similar strong but somewhat flexible plastic, thermooplastic or resin material.

In the preferred embodiment the slotted grommet 120 is 2¼ inches in length. The collar 123 is roughly 0.565 inches long, and the external threads 129 run the remaining 1.68 inches of the length of the grommet 120. The slotted grommet is 1.1814 inches in diameter at the external threads 129, and the external threads 129 are 1³⁄₁₆-16 threads, which are sized to correspond to the inner threads 119 of the grip extension 110 such that the slotted grommet 120 can screw into the bottom 118 of the grip extension 110, as described more fully below. The collar 123 has an outer diameter of 1¼ inches to correspond to the outer diameter of the grip extension 110.

The central shaft opening 125 is tapered, and has a slightly larger diameter at the grommet top 121 than the grommet bottom 122. This taper is configured to mirror the taper of the shaft 11 which is inserted into the central shaft opening 125. In the preferred embodiment the central shaft opening 125 has a 1.066 degree taper. In the preferred embodiment the central shaft opening has a diameter at the grommet top 121 of 0.5673 inches, and an opening at the grommet bottom 122 of 0.525 inches. In alternate embodiments the openings can vary in diameter by as much as 0.05 inches in either direction to accommodate clubs with larger or smaller shafts. In one alternate embodiment the diameter at the grommet top is 0.585 inches. It is possible, and within the conception of the invention, to have multiple grommets 120 with multiple shaft opening 125 sizes to accommodate clubs of varying sizes. In an alternate embodiment there is a countersink at the grommet top 121 to accommodate the grip bottom 18.

To attach the grip extension 110 to the club 10, the end cap 70 is securely attached to the top end 117 of the grip extension 110, then the cupped plug 40 is inserted into the central bore 111 to produce the appropriate length of tube for insertion of the grip 12 of the club 10. In the preferred embodiment the cupped plug 40 is inserted 11.44 inches up from the end of the internal threads 119: the internal threads 119 run the first 1.75 inches, then the cupped plug 40 is inserted and secured another 11.44 inches up the inner bore 111, or 13.19 inches from the bottom end 118. The cupped plug 40 can be secured at this position of a couple of ways. First, the central bore 111 can be machined with a stop or detent at 13.19 inches, or the cupped plug 40 can be glued into position at this location. Once the cupped plug 40 is secured, the grip 12 end of the club 10 is inserted into the central bore 111. The grip top 17 will slide into the cupped plug 40. The cupped plug 40 is sized to allow the grip top 17 to slide into place. It is beveled to allow clubs 10 having different sized grips 12 and therefore different sized grip tops 17 to be secured into the cupped plug 40. This prevents movement of the end of the club when in place inside the inner bore 111.

Part of the shaft 11 and grip 12 will be extending from the bottom end 118 of the grip extension 110. The slotted grommet 120 can be slid over the shaft 11 because the slot 124 is sized to fit over the shaft 12. The slot 124 is sized to fit over the shaft near the bottom 15, and then slid up toward the grip 12. The slotted grommet 120 is slid onto the shaft 11 with the grommet top 121 at the top to align with and screw into the grip extension 110.

The central shaft opening 125 is tapered slightly to follow the downward taper of the shaft 11 of the club 10. This has two purposes. First it prevents the grommet bottom 122 edge from pressing against the shaft 11. But it also aids in securing the shaft 11 in the grip extension 110. As the grommet 120 is screwed into the grip extension 110 the central shaft 125 opening moves upward and engages fully onto the shaft 11 to secure the club 10 into the grip extension 110. When the club with the grip extension 110 is swung there is centrifugal force that pulls the club 10 and shaft 11 downward. This puts a force against the inside of the central shaft opening 125, which creates a force that pushes out on the grommet 120, which further holds the grommet 120 in place within the threaded end 119 of the grip extension 110.

Golf clubs have varying shaft 11 sizes and varying grip sizes. The cupped plug 40 allows clubs with varying grip sizes to be held firmly within the grip extension 110, and the slotted grommet 120 accommodates different size shafts 11. For wider shafts the slotted grommet 120 will grab the shaft 11 before being screwed deeply into the bottom 118 of the grip extension 110. if the shaft is smaller, meaning has a smaller diameter, the slotted grommet 120 must be screwed further into the grip extension 100. As the slotted grommet 120 is screwed into the grip extension 110 the taper moves further up the club and eventually engages the club shaft 11.

Figure 9:
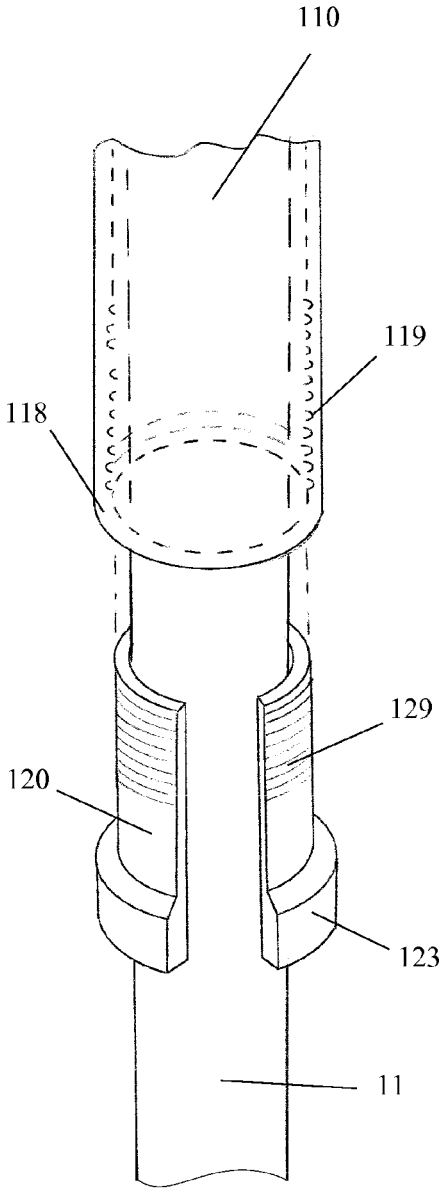
FIG. 9 is a perspective view of the grommet on the shaft of the club and in position to be screwed into the threaded end of the grip extension.
Figure 10:
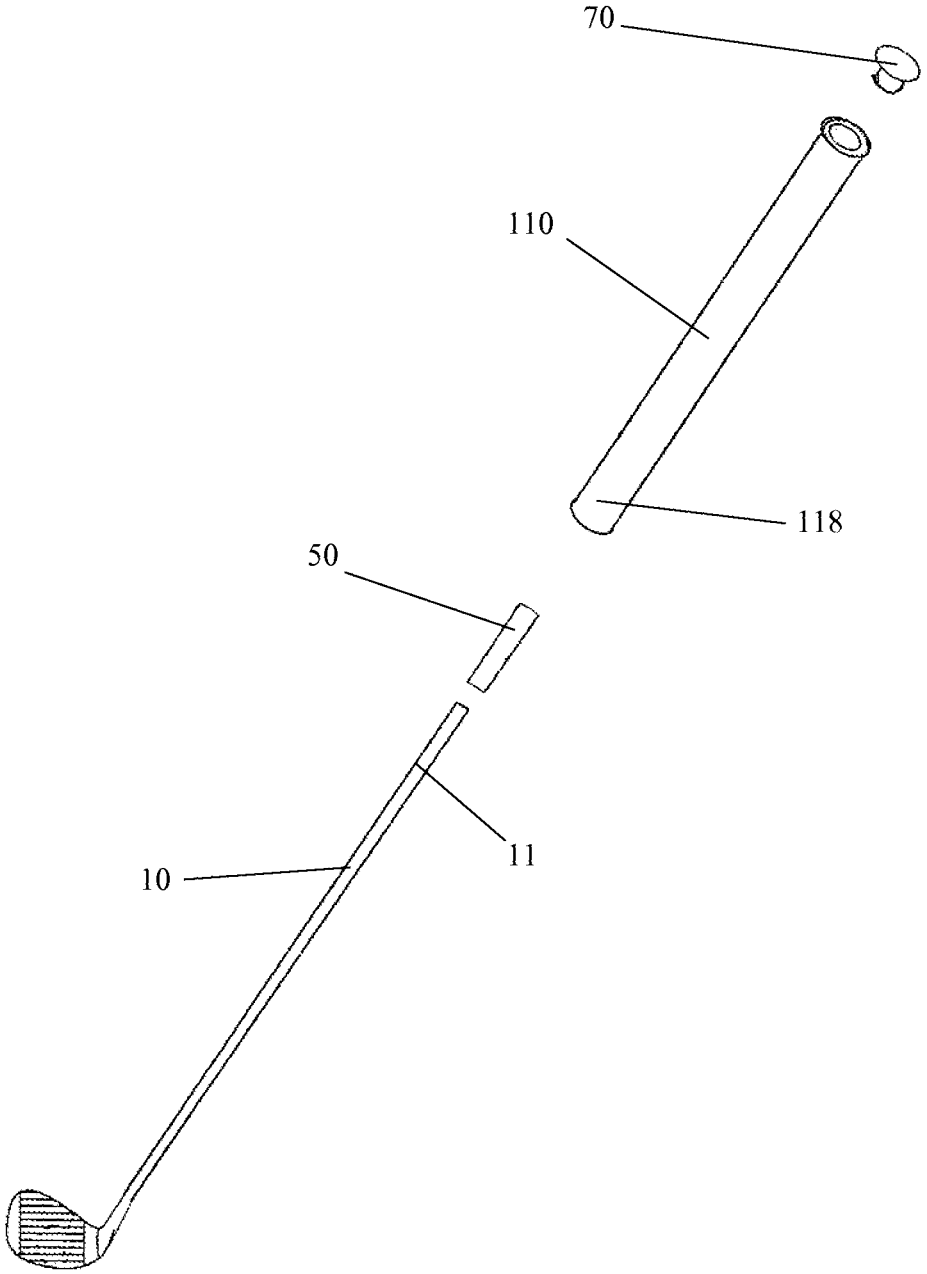
FIG. 10 is an exploded perspective view of the second embodiment of the grip extension.

There is an alternate embodiment of the invention which is smaller, and designed for smaller golfers, meaning younger or junior golfers, or women golfers, and is shown in FIG. 9. In this embodiment the grip extension 110 is an aluminum tube with a 0.75 inch outer diameter and a 0.61 inch inner diameter, and a wall of 0.065 inches thick. In alternate embodiments these dimensions can vary slightly, but the inner diameter needs to be roughly the size of the outer diameter of a golf club, and the outer diameter cannot be significantly larger than a standard golf grip 12, otherwise the user will not feel as if he or she is swinging a golf club. In the preferred embodiment the extended grip 110 is 32 inches long.

In this alternate embodiment, as shown in FIG. 9, there is no grip 12 on the club 10. There is a sleeve 50 which is inserted onto the shaft 11 near the end 17 to increase the outer diameter of the shaft 11. The sleeve 50 is a thin metal tube, though other suitable materials could be used. The sleeve 50 is attached to the shaft 11 by means of an epoxy glue. In the preferred embodiment the glue is a 3-M Brand, Scotch-Weld epoxy adhesive DP 420, which is specifically designed for use in golf clubs. Other suitable adhesives may be used. Once the sleeve 50 is attached to the end of the shaft 11, the shaft 11 with the sleeve 50 is inserted into the inner bore 111 of the grip extension 110, and securely attached by means of an epoxy glue or other suitable adhesive. In the preferred embodiment the glue is a 3-M Brand, Scotch-Weld epoxy adhesive DP 420, which is specifically designed for use in golf clubs. This securely attaches the grip extension 110 to the end of the club 10. It is possible to then add a standard golf grip 12 to the grip extension 110.

Figure 11:
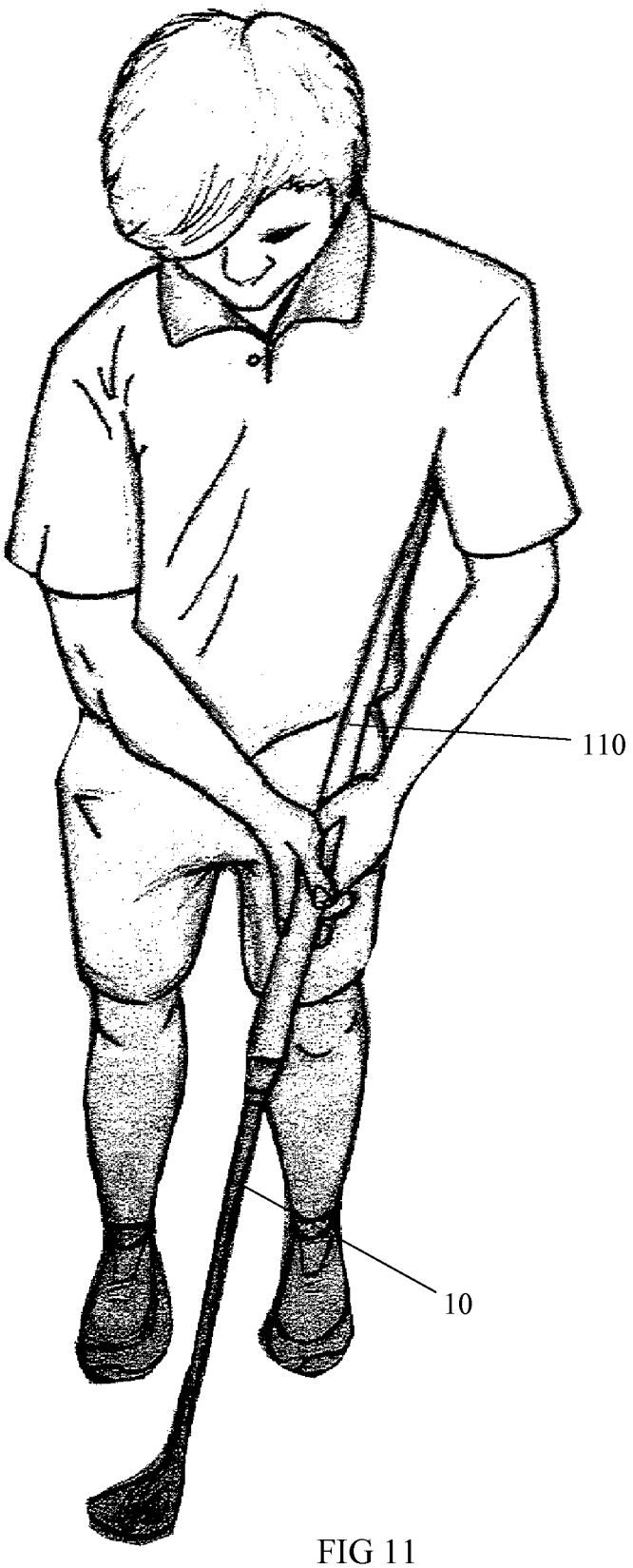
FIG. 11 is a perspective view of a golfer holding the second embodiment of the grip extension in the proper position.
Figure 12:
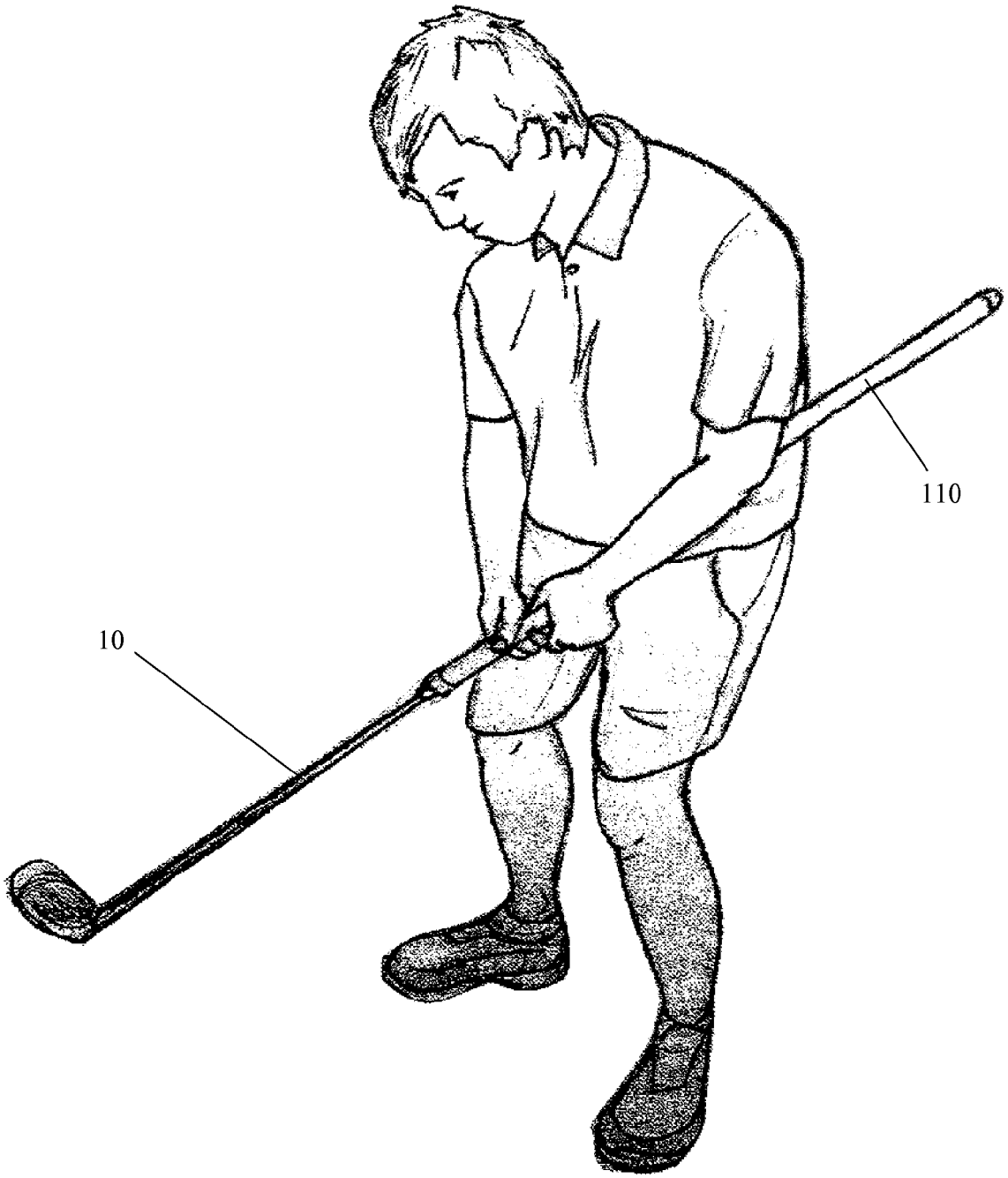
FIG. 12 is a perspective view of a golfer holding the grip extension in the proper position.

FIG. 12 shows a golfer holding the club 10 with grip extension 110. FIG. 11 shows the second embodiment which is designed for smaller golfers, such as women, or youth golfers. As can be seen, the golfer holds the extended grip 110 in the normal position and normal fashion, and the extended grip 110 is pressed against the left side below the arm pit. This will be the normal position for a right handed golfer. It will be the opposite for a left handed golfer. In this position, if the club is swung with rotation of the wrists the extended handle will move away from the body and will slap against the body when the golfer swings the club. This will notify the golfer that too much wrist is being used in the chip shot. As a training aid the golfer will basically be forced to pinch the extended handle between the left arm and the side of the body, which will force the golfer to chip without the use of the wrists. This will help train the golfer to chip without the use of the wrists. As should be obvious, a longer training aid will be needed for a taller golfer in order for the extended grip to be in the proper position against the side of the body. In an alternate method of use, the golfer can squeeze the extended handle against the body with the arm, which will prevent the use of the wrists during the swing. For the authorized club version of the invention the golfer can use the club during play, and will chip on the course without excess use of the wrists.

Many golf training aids teach alignment or hand position, but are not designed for taking repeated practice shots. Golf is a game of repetition, and the more practice shots a golfer can take the more they will learn the proper technique, and develop the proper feel. In the second embodiment the club 10 is permanently attached within the grip extension 110, and the junior golfer can use the club repeatedly in practice to develop the proper grip and alignment position, and through repeated use, can develop the proper swing feel for the proper chip shot. In the first embodiment the golfer can use his or her standard chipping club 10 and securely, but removably, attach it to the grip extension 110 by means of the taper slotted grommet 120. The golfer can easily attach and detach the grip extension 110 and practice chipping with a variety of clubs. The golfer can then remove the grip extension 110 and use the clubs during play.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A golf chipping training aid that is attachable to a golf club comprising:

a golf club having a tapered shaft with a club head attached to a narrow end of said tapered shaft and a wider grip end with a grip disposed on said grip end; wherein said tapered shaft has a smaller diameter at said narrow end and a larger diameter at said grip end;

an elongated hollow grip extension having an inner bore sized to accommodate the grip at the grip end of the golf club, and an internally threaded end disposed within said inner bore;

a threaded grommet having a tapered central opening and a slot sized to allow the narrow end of said tapered shaft near where the club head is attached to slide into said grommet and allow said grommet to slide toward said wider grip end, wherein said tapered central opening is tapered and sized to engage said tapered shaft, and wherein said threaded grommet is configured to engage and screw into said internally threaded end such that said tapered grommet can be placed around said shaft, said grip inserted into said inner bore, and said threaded grommet screwed into said internally threaded end to securely and removably attach the golf club to said grip extension; and wherein when said grip extension is held by a golfer against the body said grip extension prevents excess wrist movement when swung by the golfer to teach proper chipping technique.

2. The golf club training aid of claim 1 wherein the tapered central opening of the threaded grommet allows the grip extension to be attached to golf clubs having different sized shafts thereby allowing the training aid to be removably attachable to multiple clubs.

3. The golf chipping training aid of claim 1 further comprising;

a cupped plug having a curved inner cup portion, said cupped plug securely inserted into said inner bore to create a stop and to engage the grip of the club to prevent movement of the grip within the inner bore of the grip extension.

4. The golf chipping training aid of claim 3 wherein the cupped plug allows the grip extension to engage clubs having grips of varying sizes, thereby allowing the training aid to be removably attachable to multiple clubs.

5. The golf chipping training aid of claim 1 wherein said grip extension is attached to said golf club, and wherein a golfer grips said grip extension near said club and holds said grip extension against the golfer's side and practices a golf stroke wherein said grip extension prevents the golfer's wrist from excessive movement during the swinging motion of a golf chip shot, thereby teaching the proper chipping technique.

6. The golf chipping training aid of claim 1 wherein said threaded grommet removably attaches the golf club to the grip extension with sufficient strength to allow use of the club in striking a ball during a practice chip.

* * * * *